United States Patent [19]

Schieber et al.

[11] 4,118,955

[45] Oct. 10, 1978

[54] YARN FEED ARRANGEMENTS FOR KNITTING MACHINES

[75] Inventors: Hans Schieber, Bopfingen; Winfried Lutz, Bopfingen-Flochberg, both of Germany

[73] Assignee: Universal Maschinenfabrik Dr. Rudolf Schieber KG, Westhausen, Germany

[21] Appl. No.: 843,306

[22] Filed: Oct. 18, 1977

[30] Foreign Application Priority Data

Oct. 19, 1976 [DE] Fed. Rep. of Germany ..... 2647187

[51] Int. Cl.[2] ..... D04B 35/12

[52] U.S. Cl. ..... 66/158; 66/146; 66/125 R

[58] Field of Search ..... 66/125, 157, 158, 159, 66/163, 146, 132; 57/106, 108

[56] References Cited

U.S. PATENT DOCUMENTS

| | | | |
|---|---|---|---|
| 2,989,796 | 6/1961 | Ashe | 66/163 |
| 3,583,145 | 6/1971 | Fisher | 57/106 |
| 3,835,632 | 9/1974 | Kishida et al. | 57/106 |
| 3,851,502 | 12/1974 | Hopkins | 66/163 |

FOREIGN PATENT DOCUMENTS

| | | | |
|---|---|---|---|
| 1,904,219 | 8/1970 | Fed. Rep. of Germany | 66/125 |
| 296,212 | 8/1928 | United Kingdom | 66/125 |

*Primary Examiner*—Ronald Feldbaum

*Attorney, Agent, or Firm*—Sughrue, Rothwell, Mion, Zinn and Macpeak

[57] ABSTRACT

A flat knitting machine has a bobbin carrier rotatably supporting yarn bobbins from which yarns are led off to a rotary carriage through a protective device in the form of a channel member or tube for each yarn, to reduce the effects of air resistance and material attraction between the yarns. Deflector pulleys can be provided to increase the lengths of yarn within the protective device and yarn breakage detectors can be positioned at the entries to and exits from the device.

6 Claims, 4 Drawing Figures

YARN FEED ARRANGEMENTS FOR KNITTING MACHINES

The invention relates to a yarn feed for a knitting machine.

A yarn feed for a flat knitting machine having a rotary carriage and rotary yarn bobbins from which the threads are led to the carriage through guide eyes provided thereon is known from the journal "Wirkerei- und Strickereitechnik", Coburg, February 1957, No. 2., pages 21, 22. Also, West German OS 23 60 507 discloses a stationary bobbin frame on a circular knitting machine in which the threads are led from the bobbins to the knitting machine through stationary yarn feed tubes. The yarn feed tubes are charged with compressed air.

In flat knitting machines having rotary carriages, problems arise in the feeding of the yarn from the yarn bobbins to the carriage, particularly when the machine is brought to a stop. Thus, if the stopping mechanism of the knitting machine is tripped by a safety device which senses for example a yarn breakage, the carriage runs on over a certain braking distance. The yarn between the point where the yarn breakage has occurred and the working point on the carriage must be long enough to guarantee satisfactory knitting whilst the carriage is braked to a stop. If the yarn is not long enough, holes occur in the knitting.

Thus it is necessary to provide a sufficient length of thread between the sensing position for yarn breakage and the knit point on the carriage. Long threads have the disadvantage however at high knitting speed that the air resistance which arises pulls the threads from the bobbins even when they are not being knitted. This leads to frequent stopping of the knitting machine by the safety devices for the yarn. The theads moreover must run very close together to the carriage and because of static charging, they attract one another and tend to come together. If this occurs, a stationary thread may be caught by an adjacent moving thread and taken along with it, and this also disrupts the functioning of the knitting machine.

The object of the invention is accordingly to provide a yarn feed which permits an adequately long run of yarn between the yarn bobbin and the carriage of the knitting machine, without the threads being mutually affected and impeded, and adversely affected externally.

In accordance with the invention therefore a protective device is provided between the yarn bobbins and guide eyes for leading the yarn into the carriage, the device being arranged for the protection of the threads from one another and against the influence of air resistance.

The protective device can comprise shields open at one side so as to be easily accessible to attention to the yarns which nevertheless offer the required protection against mutual and external influences on the yarns.

Advantageously there are arranged inside the protective device at least two deflectors for extending the run of the yarn inside the device. The yarn can thus be led up and down inside the protector a number of times, whereby a small structural height for the device can be combined with a considerable length of run of the yarn. The deflectors are advantageously deflector rollers.

It is also advantageous to provide a safety device at the entry of each yard into the protective device and another such device at the outlet, the safety devices being arranged to sense a yarn breakage and bring about stoppage of the machine.

The protective device may be formed as complete tubes, so as to be closed at the front. Protection of the yarn on all sides is thus achieved by the tubes in the critical region of the yarn feed. The threads may easily be threaded through the tubes by means of a small weight provided with a hook.

If the feed of a flat knitting machine is provided with bobbin carriers separate from the carriages and rotating on their own guideways, the protective device is advantageously fitted to the bobbin carriers. By this means transmission of oscillations from the protective device to the carriage is avoided.

The invention is further explained below with reference to the accompanying drawings, in which:

FIG. 1 diagrammatically shows, from the side and partly in action, a carriage and a bobbin carrier, with a protective device for the threads in accordance with the invention arranged between them;

Figure 1:
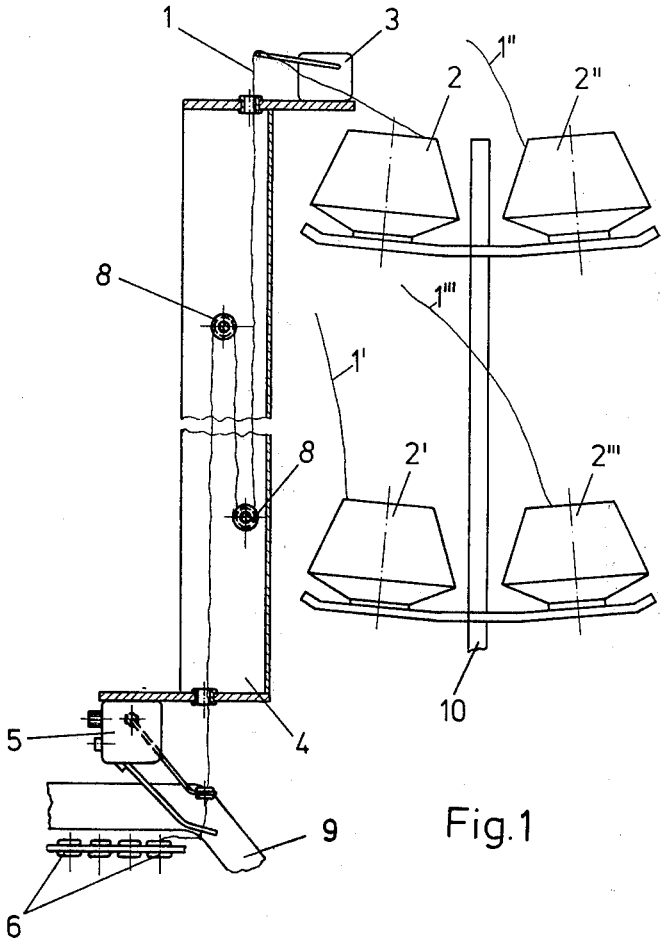
Figure 2:
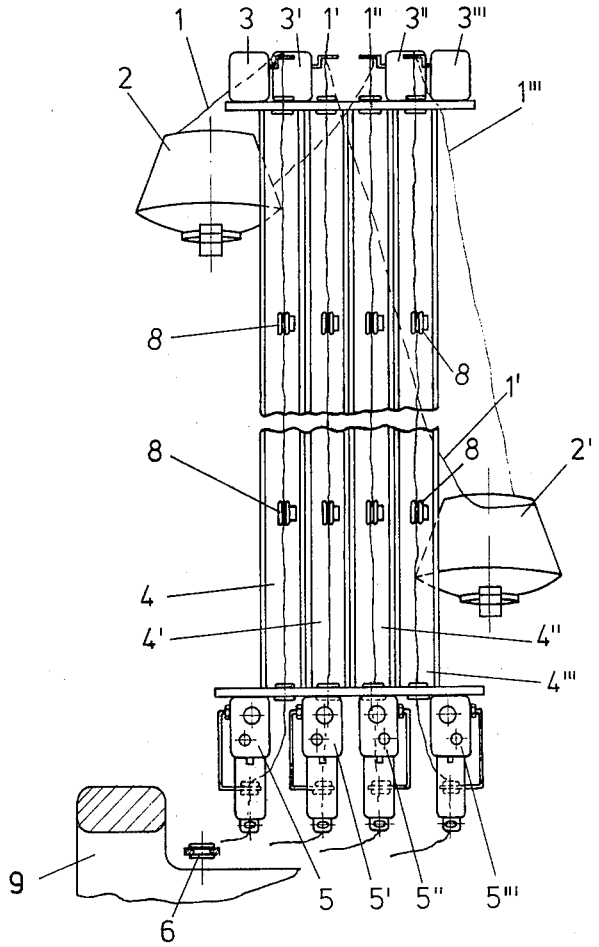
FIG. 2 is a front view of the arrangement of FIG. 1.

In the yarn feed illustrated in FIGS. 1 and 2, a protective device for the run of the yarn is provided between a bobbin carrier 10 and a carriage 9 of an associated knitting machine. The protective device consists of shell-shaped or channel-like protectors or sheilds 4,4', 4'', 4''' arranged side by side, through which run threads 1, 1', 1'', 1'''. The channel shaped shields 4, 4', 4'', 4''' are open towards the front and each contains two deflector rollers 8. The yarns 1, 1', 1'', 1''' extend from bobbins 2, 2', 2'', 2''' provided on the bobbin carrier 10 through respective safety devices 3, 3', 3'', 3''' provided at the entries to the protective device into the protective device, are entrained therein over the deflector rollers 8 and continue through further safety devices 5, 5', 5'', 5''' provided at the outlets from the protective device to guide eyes 6 provided on the carriage 9. From there, the yarns 1, 1', 1'', 1''' are fed in the usual way to the feeders.

Figure 3:
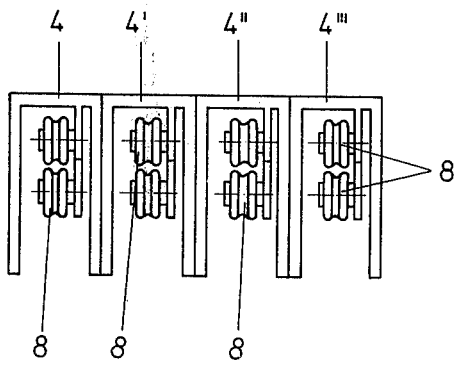
FIG. 3 is a plan view of the protective device of FIGS. 1 and 2.

The deflector rollers 8, the arrangement of which appears from FIGS. 1 and 3, increase the length of the yarns in the interior of the protective device in such a way that upon stopping of the knitting machine by the safety devices 3 to 3', up to complete standstill of the carriage 9, no gaps arise in the knitting and so that no rethreading is required.

Figure 4:
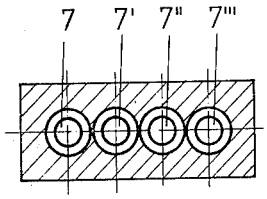
FIG. 4 is a plan of a modified protective device in accordance with the invention.

FIG. 4 shows a modified form of protective device, in which instead of the channel-shaped protectors 4 to 4''' there are provided tubes 7, 7', 7'', 7''' arranged side by side. This arrangement closes off the threads 1, 1', 1'', 1''' in the region of the protective device on all sides from the outside and also from one another. Threading of the yarns 1, 1', 1'', 1''' into the tubes 7, 7', 7'', 7''', which in contrast to the shell-shaped protectors 4 to 4''' are not accessible from the front, is easily effected by means of small weights provided with hooks. The tubes 7, 7', 7'', 7''' do not have to have a circular cross-section as shown in FIG. 4, but may, for example, have a rectangular crosssection instead.

It is evident that those skilled in the art may make numerous modifications of the specific embodiments described above without departing from the present inventive concepts. It is accordingly intended that the invention shall be construed as embracing each and every novel feature and novel combination of features present in or possessed by the apparatus herein described and that the foregoing disclosure shall be read as illustrative and not as limiting except to the extent set forth in the claims appended hereto.

We claim:

1. A knitting machine comprising rotary carriage means, bobbin carrier means adapted to rotatably support a plurality of yarn bobbins and a yarn feed means for feeding yarns from bobbins rotatably supported on said carrier means to said carriage means, said yarn feed means comprising a plurality of shields each adapted to extend only partially around a respective one of said yarns to protect said yarns from one another and from air resistance, said shields comprising channels open in the direction of travel of said carriage means.

2. The knitting machine of claim 1 having at least two deflector pulleys located within said channels to extend the path length within said channels of yarn entrained around said pulleys.

3. The knitting machine of claim 1 having deflector means within said yard feed means adapted to extend the length of yarn therewithin.

4. The knitting machine of claim 1 wherein said bobbin carrier means comprises bobbin carriers separate from said carriage means and rotatable on respective guideways and wherein said yarn feed means is mounted on said bobbin carriers.

5. The knitting machine of claim 1 having yarn breakage detector means at the entry to and at the exit from said yarn feed means.

6. A knitting machine having a yarn feed protective device, said device comprising a plurality of elongated laterally open channel members disposed in side by side relationship, a plurality of pulleys freely journalled in said channel member about axes substantially at right angles to the length of the channel member, and a guide eye at each end of each channel member, the pulleys and guide eyes being located so as to define a path between said guide eyes for yarn entrained around said pulleys which exceeds in length the distance between said guide eyes.

* * * * *